United States Patent [19]

Nakamura et al.

[11] Patent Number: 4,613,526

[45] Date of Patent: Sep. 23, 1986

[54] METHOD OF PRODUCING COATED PAPER

[75] Inventors: Masato Nakamura; Takashi Kamioka, both of Amagasaki, Japan

[73] Assignee: Kanzaki Paper Mfg. Co., Ltd., Tokyo, Japan

[21] Appl. No.: 782,723

[22] Filed: Oct. 1, 1985

Related U.S. Application Data

[63] Continuation-in-part of Ser. No. 609,337, May 11, 1984, abandoned.

[30] Foreign Application Priority Data

May 25, 1983 [JP] Japan ..... 58-9319400

[51] Int. Cl.[4] ..... B05D 3/12; B05C 3/02; B05C 11/02

[52] U.S. Cl. ..... 427/356; 118/126; 118/410; 118/413; 427/358

[58] Field of Search ..... 118/126, 410, 413; 427/356, 358

[56] References Cited

U.S. PATENT DOCUMENTS 4,250,211 2/1981 Damrau et al. ..... 427/356
4,331,713 5/1982 Girard et al. ..... 427/209

*Primary Examiner*—Michael R. Lusignan

[57] ABSTRACT

A method of producing coated printing paper by the use of a blade coater. A flexible blade is pressed against a paper web carried by a backing roll, by a support member disposed on the opposite side of the blade so that the blade is bent to a specific curve. The bent blade serves to remove the excess coating applied to the paper web, with improved results. The dwell time that the coating is in contact with the paper before the excess is removed by the blade is kept to a very short period.

13 Claims, 3 Drawing Figures

METHOD OF PRODUCING COATED PAPER

CROSS REFERENCE TO RELATED APPLICATION

This application is a continuation-in-part of our copending application Ser. No. 609,337, filed May 11, 1984, now abandoned.

BACKGROUND OF THE INVENTION

The present invention relates to a method of producing coated paper. More particularly, the invention relates to a method of efficiently producing high grade coated paper having excellent printability such as good ink gloss and ink smoothness, by the utilization of a novel blade coater.

In a method of producing coated paper in which coating composition is applied to a moving web of base paper, the role of a blade coater has become increasingly more important as the solids content of the coating compositions is increased and operating speeds are increased. A blade coater can generally facilitate a uniform control of coating weight, provide excellent runnability of high solids coating compositions and produce coated paper having relatively good smoothness and gloss.

However, the conventional application of coating by the use of blade coaters has encountered problems related to the increase in the solids content of the coating compositions and in the viscosity of such and further in the trend toward higher coating speeds. If a coating composition having a high solids content is applied at a high speed, the coating weight is liable to increase. To prevent the increase of the coating weight, it is necessary to further increase the pressure applied to the blade in order to wipe or scrape off the excess. As a result, the smoothness of the coated paper is lost. Particularly, it is difficult to obtain high grade printing paper which needs good ink gloss and ink smoothness. Further, the solids content of the coating layer increases and its water content decreases during the dwell time, that is, the time interval between the time when the coating composition first contacts the base paper and the time when the excess coating is wiped or scraped off, with the result that defects such as streaks and scratches in the coating are liable to occur.

Japanese Patent Publications No. 29471/1968 and No. 40460/1973 disclose coating methods for obtaining a relatively smooth coated layer, particularly a coated layer having a good profile across the width of the base paper, in which the excess coating is scraped off by a part of the curved surface of a bent blade. However, these methods have the disadvantages that it is difficult to apply a uniform coating weight and difficult to prevent defects such as streaks and scratches in the application of coating compositions having high solids content or in the high speed application of the coatings because the dwell time of the coating composition is long.

A coating method for shortening the swell time is proposed in Japanese Patent Laid-Open Publication No. 84770/1982. However, while this method can suppress the occurrence of defects such as streaks and scratches to some degree, it is still difficult to control the coating weight, with the result that uneven coating and decrease in the smoothness of the resulting coated paper cannot be avoided.

BRIEF SUMMARY OF THE INVENTION

It is an object of this invention to provide a method of producing coated paper which obviates the above-mentioned disadvantages of the conventional blade coaters for obtaining high-grade coated paper by applying at a high speed a mineral pigment coating having a high solids content. We have discovered that the runnability and the quality of coated paper can be remarkably improved if a flexible blade is pressed against the paper web backing roll, by means of a support member disposed on the side of the blade opposite to said backing roll, so that said blade is bent with its front section in pressing contact with the paper web traveling over said backing roll and with its back section forming a specific curved surface. Furthermore, means are provided for shortening the dwell time.

The present invention provides a method of producing coated paper by applying a high solids coating composition onto a continuously moving base paper by means of a blade coater, in which the improvements comprise:

(a) a flexible blade being pressed against a web, traveling over a backing roll, by a support member disposed on the side of the blade opposite to said backing roll, so that said blade is bent with the front section of said blade in pressing contact with said backing roll, and with its back section forming a specific curved surface, the curved surface of the back section of said bent blade being maintained within a zone formularized as follows:

$$Y>0.03X^2,\ Y<0.5X^2,\ \text{and}\ 0<X\leqq 2\ \text{cm}$$

where a point of contact, farthest from the front edge of said blade, between said blade and said backing roll, is the origin, a line tangent to said backing roll at said origin is the X-axis, and a line normal thereto at said origin is the Y-axis;

(b) means for providing a time interval of 0.0005 to 0.015 second between the time when coating composition in excess is applied to the base paper, and the time when the excess coating is wiped off by means of said blade.

DETAILED DESCRIPTION OF THE PREFERRED EMBODIMENTS

Figure 2:
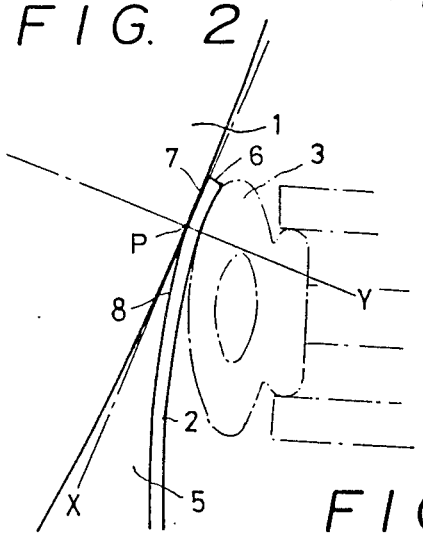
FIG. 2 is an enlarged partial view illustrating said backing roll and bent blade, P representing the point of contact between said blade and said backing roll furthest removed from the front edge 6 of said blade, X representing a line tangent to said backing roll at the point P, Y representing a line normal to said backing roll at the point P, 7 representing the front section of said blade, and 8 representing the back section of said blade.
Figure 1:
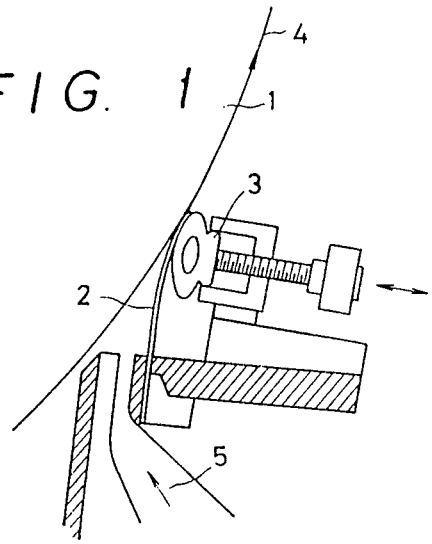
FIG. 1 is a schematic view illustrating the positional relationship between a backing roll 1, a flexible blade 2 and a support 3, of a blade coater used in a method of the present invention.

In a blade coater used in the present invention, as shown in FIG. 1, a flexible blade 2 is pressed by support 3 against a paper web on backing roll 1 of the blade coater; the front section 7 of blade 2 is in contact with the paper web on said backing roll 1 so as to scrape off excess coating from the surface 4 of the paper. The coating composition is supplied to the surface 4 of the paper web through the coating supply passage 5 in the vicinity of the end of the blade 2.

Figure 3:
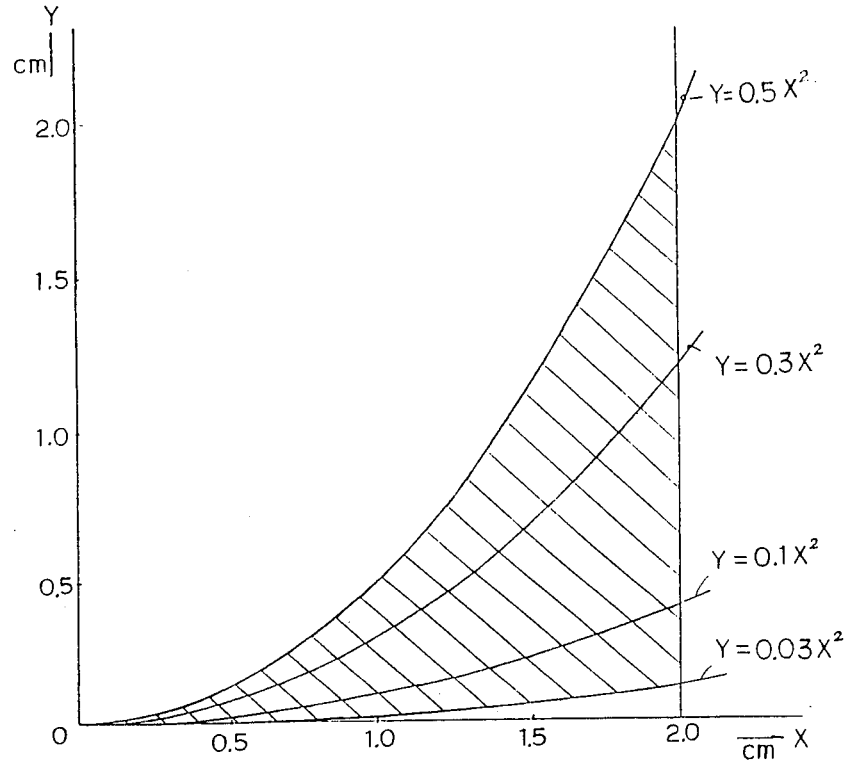
FIG. 3 is a graph showing the zone within which the curved surface of the bent blade facing the backing roll should be maintained on an X-Y plane in FIG. 2.

In a method of the invention, the support 3 is pressed against the back surface of the flexible blade 2 to bend the blade 2 so that the surface of the back section 8 of blade 2 is curved within the shaded zone in FIG. 3, that is, within a zone formularized as follows:

$$Y>0{,}03X^2,\ Y<0.5X^2,\ \text{and}\ 0<X\leqq 2\ \text{cm}$$

where a point P of contact farthest from the front edge 6 of said blade, between the blade 2 and the backing roll 1, is the origin, a line tangent to the backing roll 1 at point P is the X-axis, and a line normal thereto is the Y-axis;

It is preferable that said support 3 is pressed against the back surface of the blade 2 at a distance of approximately 0 to 4 cm, preferably approximately 0 to 3 cm, from the front edge 6 of the blade.

Such a support 3 may be, for example, a rubber air tube, or a metal pressing means, or other means which can apply uniform force to the blade and further impart a smooth deflection to the blade with the result of obtaining coated paper having excellent smoothness. Preferably said support 3 has a curved surface similar to the specific curved surface of the blade described alone, and said support 3 is pressed against the back surface of the blade near its front edge 6 so that the blade is bent along the curved surface of said support.

In the present invention, if $Y\leqq 0.03X^2$, the coating weight becomes excessive, and it becomes difficult to maintain uniform coating weight. If $Y\geqq 0.5X^2$, the pressure applied to the front section 7 of the blade 2 becomes excessively large, the smoothness of the coated paper is remarkably lost, and grit or other foreign material and rough pigment particles are less liable to pass under the blade, with the result that defects such as streaks or scratches readily occur. Consequently, in the range of $0<X\leqq 2$ cm, adjustment is made so that $Y>0.03X^2$ and $Y<0.5X^2$, preferably $Y<0.3X^2$, more preferably $Y<0.1X^2$.

The blade used in the method of the present invention may be made of a steel having sufficient flexibility and strength, and preferably, has a thickness of 0.2 to 0.6 mm. A blade which has no beveled edge at the front edge 6 is preferably used, although a blade which has a bevel angle of less than 20° may be used. However, if the bevel angle of the blade is too large, it is difficult to obtan coated paper having excellent smoothness because the area for scraping off the excess coating is reduced.

The backing roll 1 is generally rubber covered and in order to impart sufficient smoothness to the resultant coated paper, it is preferable that the rubber hardness, stipulated by a method of JIS-Z2246, is 60 to 80.

It is only the back section 8 of the blade 2 that must maintain the curved surface within the specific zone.

According to the above described blade mechanism of the present invention, the blade pressure per unit area applied to the base paper and coating layer is relatively low. Accordingly, foreign materials and rough pigment particles in the coating may readily pass under the blade together with the coating layer, with the result that defects such as streaks or scratches can be reduced, and coated paper having excellent smoothness can be efficiently obtained.

Further, in the method of the present invention, the time interval between the time when excess coating is supplied to the web of base paper by the supply passage 5 and the time when the excess coating is scraped off, is extremely short, 0.0005 to 0.015 second, preferably 0.001 to 0.01 second. Such a coating method can be performed by adjusting the distance between the applicator mechanism for applying coating to the base paper and the blade mechanixm for scraping off the excess coating, to a range of 0 to 16 cm, preferably 0 to 12 cm, and more preferably 0 to 7 cm. If a coating having a high solids content is scraped off by the blade after the lapse of more than 0.015 second, it becomes difficult to control the coating weight of the coating because of the decrease of the water content of the coating layer and the increase in the solids content of the coating layer, resulting in the occurrence of defects such as streaks and scratches. A time interval of less than 0.0005 second means that the speed of the coater is more than 3000 m/sec. This causes a difficulty in operation at present.

When the time interval between the supplying of the coating to the base paper and the scraping off of the excess coating is shortened as described above, defects such as streaks or scratches can be remarkably reduced even if a coating having a high solids content is used, due to the merits of the blade mechanism as described above because a decrease in the water content of the coating after being applied to the base paper can be reduced greatly. Since the coating weight of the coating can be controlled by a blade pressure which is relatively low compared to that used in a conventional method, the solids content of the coating can be increased, and coated paper of high quality having excellent paper gloss, smoothness, ink gloss after printing, can be obtained. Thus the method of this invention is very effective in increasing the solids content of the coating. Further, the facility and energy required for drying can be reduced because of an increase in the solids content of the coating.

Coating compositions used in the method of the present invention are not particularly limited, and may contain pigment commonly used in producing coated paper, such as kaolin, natural ground calcium carbonate, precipitated calcium carbonate, satin white, titanium dioxide, pyrophyllite clay, calcium sulfite, calcium sulfate, aluminum hydroxide, zinc oxide, talc, zeolite, barium sulfate, amorphous silica and plastic pigments; well-known adhesives such as alkali-sensitive or alkali-non-sensitive adhesives including styrene-butadiene copolymers, styrene-acrylic copolymers, vinyl acetate-acrylic copolymers, ethylene-vinyl acetate copolymers, butadiene-methyl methacrylic copolymers, vinyl acetate-butyl acrylate copolymers and polyvinyl acetate; synthetic adhesives including polyvinyl alcohol, maleic anydride-styrene copolymer, isobutene-maleic anhydride copolymer and acrylic acid-methyl methacrylate copolymer; and natural adhesives including oxidized starch, etherified starch, esterified starch, enzyme modified starch, cold water soluble starch obtained by flash-drying, casein and soybean protein; and, as required, various auxiliary agents such as dispersants; flow modifiers, water retention agents, anti-foaming agents, water resistance agents, lubricant, dyestuffs and pH adjustors. The solids content of the coating may be in a wide range, of 20 to 80% by weight.

As mentioned above, the method of the invention is very effective in increasing the solids content of the coating. The present invention has made it possible to produce a coated paper of high quality having excellent printability and no defects of streaks or scratches by means of a coating having a high solids content of 60 to 70% by weight.

In the method of the present invention, the coating is applied to one or both sides of the base paper by the specific coating apparatus as described above. The coating weight may be controlled in a wide range of 3 to 40 $g/m^2$ in terms of dry weight for a single surface. Both single coating and double coating are possible. The base paper includes base paper for medium-grade coated paper made of a papermaking furnish at an acid or alkaline pH, containing high-yield pulp or mechanical pulp, or base paper for high-grade coated paper containing bleached pulp.

The coated paper obtained accordingly to the method of the present invention exhibits remarkably excellent properties when it is finished and produced by a finishing unit such as a supercalender or a gloss calender, but it also may be as a matte-coated paper with or without light finishing. This coated paper may be printed by off-set printing, gravure printing, typographic printing and flexographic printing. Cut and rolled sheets may be used in printing.

The present invention will be further described in detail with reference to the following examples. The present invention is not limited to the particular examples. The parts and percentages used in the examples are parts by weight and percentage by weight, unless otherwise specified.

EXAMPLE 1, COMPARISON EXAMPLE 1

0.3 part of rosin size and 15 parts of talc filler for making paper were added to a pulp composition comprising 20 parts of bleached softwood kraft pulp and 80 parts of bleached hardwood kraft pulp. The mixture was adjusted to have a pH value of 4.5 with aluminum sulfate and the paper was produced on a Fourdrinier paper machine. The paper was then size pressed so that 1.5 $gm/m^2$, total for both surfaces, of oxidized starch was applied, and base paper having a basis weight of 55 $g/m^2$ for coated paper was obtained.

| an aqueous coating composition consisting of the following was prepared by a Cowles dissolver | |
|---|---|
| Kaolin (Ultra-White 90 from Englehard Minerals and Chemical Corp., U.S.A.): | 80 parts |
| Natural ground calcium carbonate (made by Bihoku Funka Co., Ltd., Japan, "Soften 2200") | 20 parts |
| Styrene-butadiene copolymer latex (made by Sumitomo Naugatuch Co., Ltd. Japan, "SN-307"): | 10 parts |
| Oxidized starch (made by Oji Cornstarch Co., Ltd., Japan "AceA") | 5 parts |
| Sodium polyacrylate: | 0.3 part |

The solids content of the coating was adjusted to 60%. The coating was applied on both side surfaces of the above-described base paper by a blade coater shown in FIG. 1. The time interval (dwell time) between the time when the coating was supplied to the base paper and the time when the excess coating was scraped off was 0.003 second, and the thickness and holding state of the blade were varied as listed in Table 1.

More particularly, in the zone of $0<X\leqq 2$ cm, where the point of contact P farthest from the front edge 6 of the blade, between the blade and the backing roll, is the origin, the tangent line of the backing roll surface is the X-axis, and the line perpendicular to the X-axis is the Y-axis, the value of "a" in the formula $Y=aX^2$, which represents the holding state of the blade, was varied as listed in Table 1 by controlling the angle of the blade from the X-axis, and the position and pressure of an air tube which presses the blade from behind. Other coating conditions are shown in Table 1.

The coated paper produced was finished on a supercalender. The runnability, the qualities of the coated paper before and after printing, were as listed in Table 1.

As evident from the results in Table 1, runnability and the qualities of the coated paper obtained by the method of the present invention were preferable. However, when the value of "a" was 0.02, the control of the coating weight was difficult, and the operation could not be continued. When the value of "a" was 0.55, the area of contact between the blade and the backing roll was very small; streaks occurred, and the smoothness of the obtained coated paper was poor.

TABLE 1

| | Example 1 | | Comparison Example 1 | |
|---|---|---|---|---|
| Solids content of coating composition (%) | 60 | 60 | 60 | 60 |
| Brookfield viscosity (cps) | 950 | 950 | 950 | 950 |
| Thickness of blade (mm) | 0.4 | 0.3 | 0.5 | 0.3 |
| Value of "a" | 0.08 | 0.2 | 0.02 | 0.55 |
| Conditions of coating | | | | |
| Dwell time (sec.) | 0.003 | 0.003 | 0.003 | 0.003 |
| Coating speed (m/mm) | 600 | 600 | 600 | 600 |
| Coating weight (one side, $g/m^2$) | 20 | 16 | 35 | 7 |
| Runnability (Note 1) | ◎ | ◎ | X | Δ |
| Paper gloss (before printing) (Note 2) | 63 | 61 | — | 47 |
| Smoothness (before printing) (Note 3) | ○ | ○ | — | Δ |
| Ink gloss (after printing) (Note 4) | 44 | 43 | — | 35 |

NOTES TO TABLE 1 AND TABLE 2

Note 1:

Runnability: This was evaluated in terms of defects such as streaks and the uniformity of the coated surface. Decreasing degrees of quality: (Good)◎○Δ X (Impossible to operate)

Note 2:

Paper gloss (before printing): Figures show gloss in percentage (%), measured at 75°/75° by means of an autogoniophotometer (made by Murakami Color Research Laboratory, Japan GP-1R).

Note 3:

Paper smoothness (before printing): Evaluated by visual observation. Decreasing degrees of quality: (Good)◎○Δ X (Poor)

Note 4:

Ink gloss (after printing); Coated paper was printed with 0.3 cc black ink by means of an RI printing tester made by Akira Industry Co., Japan. The gloss of the printed paper was measured in the same way as in Note 2. Measured values are shown in percentage (%).

EXAMPLE 2, COMPARISON EXAMPLE 2

A coating composition consisting of the following, was prepared by a Cowles dissolver.

| | |
|---|---|
| Kaolin (Ultra White-90): | 40 parts |
| Natural ground calcium carbonate (made by Fuji Kaolin Co., Ltd., Japan, "Carbital 90"): | 60 parts |
| Styrene-butadiene copolymer latex (made by Sumitomo Naugatuch Co., Ltd. Japan, "SN-307"): | 11 parts |
| Cold water soluble starch (made by Sanwa | 3 parts |

-continued

| | |
|---|---|
| Cornstarch Co., Ltd., Japan, "Hi-coaster PC-11") | |
| Sodium polyacrylate; | 0.3 part |

The solids content of the coating composition was varied as listed in Table 2 and the coating composition was applied on both side surfaces of the same base paper as in EXAMPLE 1 in the same manner as in the EXAMPLE 1 by means of a blade held so that the value of "a" becomes 0.2. The dwell time was varied as listed in Table 2 at altering the coating speed and the distance from the applicator mechanism to the blade mechanism. Runnability and the qualities of the coated paper before and after printing were as listed in Table 2.

As evident from the results in Table 2, the runnability of the coating composition having a high solids content was excellent, and the smoothness and ink gloss after printing of the obtained coated paper were excellent. However, when the dwell time was increased to that used in the conventional method, the water content of the coating on the paper was decreased (and the solids content was increased) by the time the excess coating was scraped off by the blade. Thus, streak occurred, and the coated paper obtained had poor smoothness because the coated layer was rough.

COMPARISON EXAMPLE 3

Coating composition was applied to both surfaces of base paper in the same manner as in Example 2 except that the coating composition was scraped off by a beveled blade (having a bevel angle of 40°) cut at a gradient of 40° at the end. The base paper and coating were the same as in EXAMPLE 2. The coating conditions, runnability and the qualities of the coated paper before and after printing are listed in Table 1.

As apparent from the results of Table 2, when a conventional trailing blade having a bevel angle as large as 40° was used, streaks were likely to occur because of a high blade pressure, the smoothness of the coated paper was poor, and it was almost impossible to carry out the coating operation at a high speed.

What we claim is:

1. A method of producing coating paper by applying an aqueous coating composition to a moving base paper web by means of a blade coater, the improvement which comprises:

(a) pressing a flexible blade against a paper web traveling over a backing roll by means of a support member disposed against said blade on the side opposite to said backing roll, to bend said blade and to bring the front section of said blade into pressing contact with said backing roll, and further to bring the back section of said blade into a specific curved surface, the curved surface of said back section of said bent blade being maintained within a zone formularized as follows:

$$Y>0.03X^2,\ Y<0.5X^2,\ \text{and}\ 0<X\leqq 2\ \text{cm}$$

where a point of contact, farthest from the front edge of said blade, between said blade and said backing roll, is the origin, a line tangent to said backing roll at said origin is the X-axis, and a line normal thereto at said origin is the Y-axis; and (b) maintaining a time interval of 0.0005 to 0.015 second between the time when an aqueous coating composition is applied, in excess, to the base paper and the time when the excess of said coating composition is scraped off the base paper by means of said blade.

2. A method as claimed in claim 1 wherein the curved surface of said back section of said bent blade is maintained within a zone formularized as follows:

$$Y>0.03X^2,\ Y<0.3X^2,\ \text{and}\ 0<X\leqq 2\ \text{cm}.$$

3. A method as claimed in claim 1 wherein the curved surface of said back section of said bent blade is maintained within a zone formularized as follows:

$$Y>0.03X^2,\ Y<0.1X^2,\ \text{and}\ 0<X\leqq 2\ \text{cm}.$$

4. A method as claimed in claim 1 in which there is a time interval of 0.001 to 0.01 second between the time

TABLE 2

| | Example 2 | | | | | Comparison Example 2 | | | |
|---|---|---|---|---|---|---|---|---|---|
| Solids content of coating composition (%) | 64 | 64 | 70 | 70 | 64 | 64 | 70 | 64 | 64 |
| Brookfield viscosity (cps) | 860 | 860 | 1550 | 1550 | 860 | 860 | 1550 | 860 | 860 |
| Blade | | | | | | | | | |
| Bevel angle (°) | — | — | — | — | — | — | — | 40 | 40 |
| thickness (mm) | 0.3 | 0.4 | 0.4 | 0.5 | 0.4 | 0.4 | 0.4 | 0.4 | 0.4 |
| value of "a" | 0.2 | 0.2 | 0.2 | 0.2 | 0.2 | 0.2 | 0.2 | — | — |
| Conditions of coating | | | | | | | | | |
| Dwell time (sec.) | 0.003 | 0.0015 | 0.003 | 0.0015 | 0.04 | 0.02 | 0.04 | 0.04 | 0.02 |
| Coating speed (m/min) | 600 | 1200 | 600 | 1200 | 600 | 1200 | 600 | 600 | 1200 |
| Coating weight (one side, g/m$^2$) | 13 | 18 | 18 | 20 | 14 | 18 | 20 | 11 | 15 |
| Runnability (Note 1) | ◎ | ◎ | ◎ | ○ | ○ | Δ | X | Δ | X |
| Paper gloss (before printing) (Note 2) | 58 | 65 | 69 | 72 | 58 | 63 | — | 55 | — |
| Smoothness (before printing) (Note 3) | ○ | ○ | ◎ | ◎ | Δ | ○ | — | Δ | — |
| Ink Gloss (after printing) (Note 4) | 44 | 49 | 51 | 52 | 43 | 48 | — | 40 | — |

when the coating composition is applied, in excess, to the base paper and the time when the excess of said coating composition is scraped off.

5. A method as claimed in claim 2 in which there is a time interval of 0.001 to 0.01 second between the time when the coating composition is applied, in excess, to the base paper and the time when the excess of said coating composition is scraped off.

6. A method as claimed in claim 3 in which there is a time interval of 0.001 to 0.01 second between the time when the coating composition is applied, in excess, to the base paper and the time when the excess of said coating composition is scraped off.

7. A method as claimed in claim 1 wherein said coating composition has a solids content of 60 to 70% by weight.

8. A method of applying high solids aqueous coating compositions to a web of paper by means of a flexible blade which comprises;

(a) applying in excess an aqueous mineral-pigment coating composition having a solids content of at least 60% by weight to a moving paper web;

(b) pressing a flexible blade against said web traveling over a backing roll, said blade being pressed against said web by means of a support member disposed against said blade on the side opposite to said backing roll so that said blade is bent, with the front section of said bent blade in pressing contact with said web carried by said backing roll and with the back section of said bent blade forming a specific curved surface maintained within a zone formularized as follows:

$$Y>0.03X^2,\ Y<0.5X^2 \text{ amd } 0<X\leqq 2 \text{ cm},$$

where a point of contact, furthest from the front edge of said blade, between said blade and said backing roll, is the origin, a line tangent to said backing roll at said origin is the X-axis, and a line normal thereto at said origin is the Y-axis; and (c) maintaining the interval between the time when said coating is applied to said web and the time when the excess of said coating is removed by said blade, in the range of 0.005 to 0.015 second.

9. A method as claimed in claim 8 wherein the curved surface of said back section of said bent blade is maintained within a zone formularized as follows:

$$Y>0.03X^2,\ Y<0.3X^2, \text{ and } 0<X\leqq 2 \text{ cm}.$$

10. A method as claimed in claim 8 wherein the curved surface of said back section of said bent blade is maintained within a zone formularized as follows:

$$Y>0.03X^2,\ Y<0.1X^2, \text{ and } 0<X\leqq 2 \text{ cm}.$$

11. A method of applying high solids aqueous coating compositions to a web of paper by means of a flexible blade which comprises:

(a) applying in excess an aqueous mineral-pigment coating composition having a solids content of at least 60% by weight to a moving paper web;

(b) pressing a flexible blade against said web traveling over a backing roll, said blade being pressed by means of a support member having a curved surface, said support member being disposed against said blade, on the side opposite to said backing roll, so that said blade is bent with the front section of said bent blade in pressing contact with said web carried by said backing roll and with the back section of said bent blade forming a curved surface maintained within a zone formularized as follows:

$$Y>0.03X^2,\ Y<0.5X^2 \text{ and } 0<X\leqq 2 \text{ cm},$$

where a point of contact, farthest from the front edge of said blade, between said blade and said backing roll, is the origin, a line tangent to said backing roll at said origin is the X-axis, and a line normal thereto at said origin is the Y-axis, the curved surface of said support member being similar to the specific curved surface of said bent blade within said zone, said blade being bent along the curved surface of said support member; and (c) maintaining the interval between the time when said coating is applied to said web and the time when the excess of said coating is removed by said blade, in the range of 0.005 to 0.015 second.

12. A method as claimed in claim 11 wherein the curved surface of said back section of said bent blade is maintained within a zone formularized as follows:

$$Y>0.03X^2,\ Y<0.3X^2, \text{ and } 0<x\leqq 2 \text{ cm}.$$

13. A method as claimed in claim 11 wherein the curved surface of said back section of said bent blade is maintained within a zone formularized as follows:

$$Y>0.03X^2,\ Y<0.1X^2, \text{ and } 0<X\leqq 2 \text{ cm}.$$

* * * * *